US009532406B2

(12) United States Patent
Viroli et al.

(10) Patent No.: US 9,532,406 B2
(45) Date of Patent: Dec. 27, 2016

(54) INDUCTION COOKING HOB WITH A POT DETECTION DEVICE AND A METHOD FOR OPERATING AN INDUCTION COOKING HOB

(75) Inventors: Alex Viroli, Forli (IT); Massimo Nostro, Forli (IT); Laurent Jeanneteau, Forli (IT); Andrea Rossi, Forli (IT)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 549 days.

(21) Appl. No.: 14/005,602

(22) PCT Filed: Mar. 20, 2012

(86) PCT No.: PCT/EP2012/054891
§ 371 (c)(1),
(2), (4) Date: Sep. 17, 2013

(87) PCT Pub. No.: WO2012/136475
PCT Pub. Date: Oct. 11, 2012

(65) Prior Publication Data

US 2014/0014650 A1 Jan. 16, 2014

(30) Foreign Application Priority Data

Apr. 2, 2011 (EP) ..... 11002775

(51) Int. Cl.
*H05B 6/12* (2006.01)
*H05B 6/06* (2006.01)
*H05B 1/02* (2006.01)

(52) U.S. Cl.
CPC ..... *H05B 6/062* (2013.01); *H05B 1/0266* (2013.01); *H05B 2213/05* (2013.01)

(58) Field of Classification Search
CPC ... H05B 6/062; H05B 1/0266; H05B 2213/05; H05B 6/065; H05B 2213/03
(Continued)

(56) References Cited

U.S. PATENT DOCUMENTS

2007/0164017 A1* 7/2007 Gouardo ..... H05B 6/065 219/626

FOREIGN PATENT DOCUMENTS

EP 1610590 12/2005
FR 2863039 6/2005
(Continued)

OTHER PUBLICATIONS

International Search Report for PCT/EP2012/054891, dated Jul. 9, 2012, 3 pages.

*Primary Examiner* — Quang Van
(74) *Attorney, Agent, or Firm* — Pearne & Gordon LLP

(57) ABSTRACT

An induction cooking hob with a pot detection device. The hob includes a cooking surface having cooking areas and/or cooking zones. The hob includes a user interface having a switch element and a display. The hob includes a control unit for controlling the cooking area(s) and/or the cooking zone(s). The pot detection device checks, if a cooking vessel is placed on the cooking area(s) and/or cooking zone(s). The control unit switches off the cooking area(s) and/or cooking zone(s), if the pot detection device has identified that the cooking vessel has been removed from the cooking area(s) and/or the cooking zone(s). The control unit stores a cooking mode of the cooking area(s) and/or cooking zone(s), which have been switched off. The display indicates that the cooking area(s) and/or cooking zone(s) have been switched off. The switch element restarts the cooking area(s) and/or cooking zone(s) in the same cooking mode.

17 Claims, 2 Drawing Sheets

Figure 1:
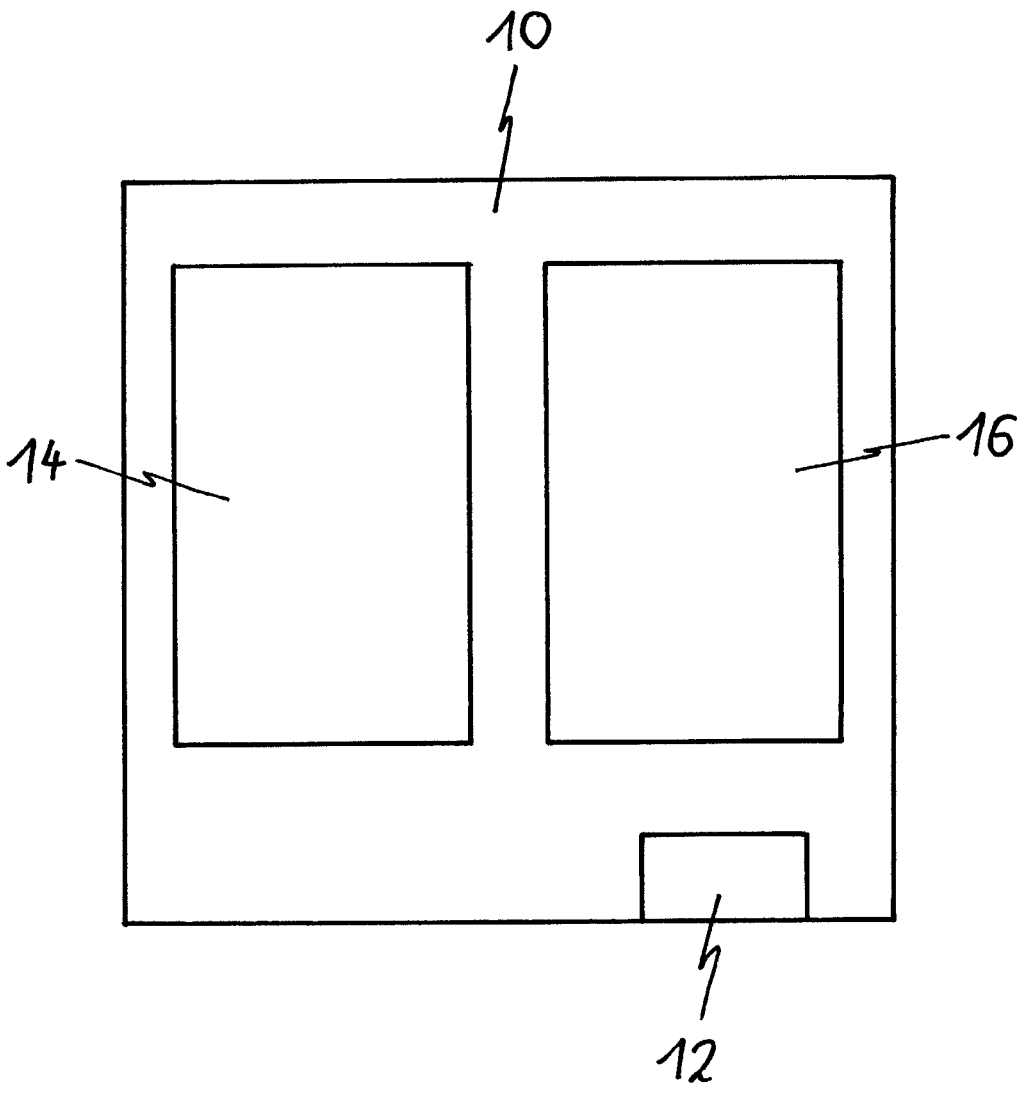

(58) Field of Classification Search
USPC ..... 219/620, 622, 624, 625, 626, 627, 662,
219/671, 672, 675
See application file for complete search history.

(56) References Cited

FOREIGN PATENT DOCUMENTS

| | | |
|---|---|---|
| WO | 2008031714 | 3/2008 |
| WO | 2009049989 | 4/2009 |

* cited by examiner

INDUCTION COOKING HOB WITH A POT DETECTION DEVICE AND A METHOD FOR OPERATING AN INDUCTION COOKING HOB

The present invention relates to an induction cooking hob with a pot detection device. Further, the present invention relates to a method for operating an induction cooking hob with a pot detection device.

The actual induction cooking hobs have usually a pot detection device. Said pot detection device informs the user, if the cooking vessel has been removed from the cooking zone. Further, the pot detection device informs the user, if the cooking vessel is not suitable for the induction cooking hob. For example, the pot detection device emits a visual or an acoustic signal.

When the cooking vessel is removed from the cooking hob, then the user is informed by the visual or acoustic signal. After said signal, the cooking hob is maintained active for a predetermined time interval. If the user puts back the cooking vessel onto the cooking surface within said predetermined time interval, then the cooking process will be set forth with the initial settings. If the cooking vessel is not placed back onto the cooking surface within said predetermined time interval, then the cooking hob is automatically switched off. This feature contributes to the safety of the cooking hob. However, if the cooking hob has been automatically switched off, then the user has to repeat the setting of the cooking parameters.

EP 2 067 377 B1 discloses an induction cooking hob with pot detection device. The cooking hob issues a warning signal, when the user places back the cooking vessel onto the cooking surface, so that the user does not place by mistake the cooking vessel on a cooking zone, which starts automatically again. A key is provided for confirming the restart of the cooking process. During this time some detection means must be activated and consume energy.

It is an object of the present invention to provide an induction cooking hob with a pot detection device, which overcomes the above problems.

The object of the present invention is achieved by the induction cooking hob according to claim 1.

The present invention relates to an induction cooking hob with a pot detection device, wherein:

- the induction cooking hob includes a cooking surface comprising one or more cooking areas and/or cooking zones,
- the induction cooking hob includes a user interface comprising at least one switch element and at least one display,
- the induction cooking hob includes a control unit for controlling the cooking area(s) and/or the cooking zone(s),
- the pot detection device is provided for checking, if a cooking vessel is placed on the cooking area(s) and/or cooking zone(s),
- the control unit is provided for switching off the cooking area(s) and/or cooking zone(s), if the pot detection device has identified that the cooking vessel has been removed from said cooking area(s) and/or the cooking zone(s),
- the control unit is provided for storing a cooking mode of that or those cooking area(s) and/or cooking zone(s), which has or have been switched off,
- the display is provided for indicating that the cooking area(s) and/or cooking zone(s) has or have been switched off, and

- the switch element is provided for restarting the cooking area(s) and/or cooking zone(s) in the same cooking mode, which has or have been switched off before.

The main idea of the present invention is the deactivation of the cooking zone or cooking area, after the cooking vessel has been removed from said cooking zone or cooking area, respectively. In doing so the control unit of the cooking hob stores the last cooking mode and informs the user about this status by the display. Then the user can restart the cooking areas and/or cooking zones switched off before in the same cooking mode.

Preferably, the control unit is provided for switching off the cooking area(s) and/or cooking zone(s) after a predetermined time interval, if the pot detection device has identified that the cooking vessel has been removed from said cooking area(s) and/or the cooking zone(s). For example, the predetermined time interval is about ten minutes.

Further, the display may comprise an icon provided for indicating that the cooking area(s) and/or cooking zone(s) has or have been switched off.

The pot detection device may be deactivated for those cooking area(s) and/or cooking zone(s), which has or have been switched off.

In a similar way, the pot detection device may be activated for those cooking area(s) and/or cooking zone(s), which has or have been restarted again.

For example, the switch element is a touch key, and the user interface is a touch screen.

In particular, the user interface may comprise a switch element for lowering the power of all active cooking area(s) and/or cooking zone(s) to a minimum level.

The object of the present invention is further achieved by the method for operating an induction cooking hob according to claim 10.

The method for operating an induction cooking hob with a pot detection device comprises the step of:

- checking the activated cooking area(s) and/or cooking zone(s), if a cooking vessel is placed thereon,
- identifying that or those cooking area(s) and/or cooking zone(s), from which the cooking vessel has been removed,
- switching off that or those cooking area(s) and/or cooking zone(s), from which the cooking vessel has been removed,
- indicating that or those cooking area(s) and/or cooking zone(s), from which the cooking vessel has been removed,
- storing a cooking mode of that or those cooking area(s) and/or cooking zone(s), which has or have been switched off, and
- providing the opportunity for the user to restart that or those cooking area(s) and/or cooking zone(s) in the same cooking mode, which has or have been switched off before.

Preferably, that or those cooking area(s) and/or cooking zone(s), from which the cooking vessel has been removed, is or are switched off after a predetermined time interval. For example, the predetermined time interval is about ten minutes.

Further, the pot detection device may be deactivated for that or those cooking area(s) and/or cooking zone(s), which has or have been switched off.

In a similar, the pot detection device may be activated for that or those cooking area(s) and/or cooking zone(s), which has or have been restarted again by the user.

In particular, the method is provided for the induction cooking hob with a pot detection device described above.

Novel and inventive features of the present invention are set forth in the appended claims.

Figure 2:
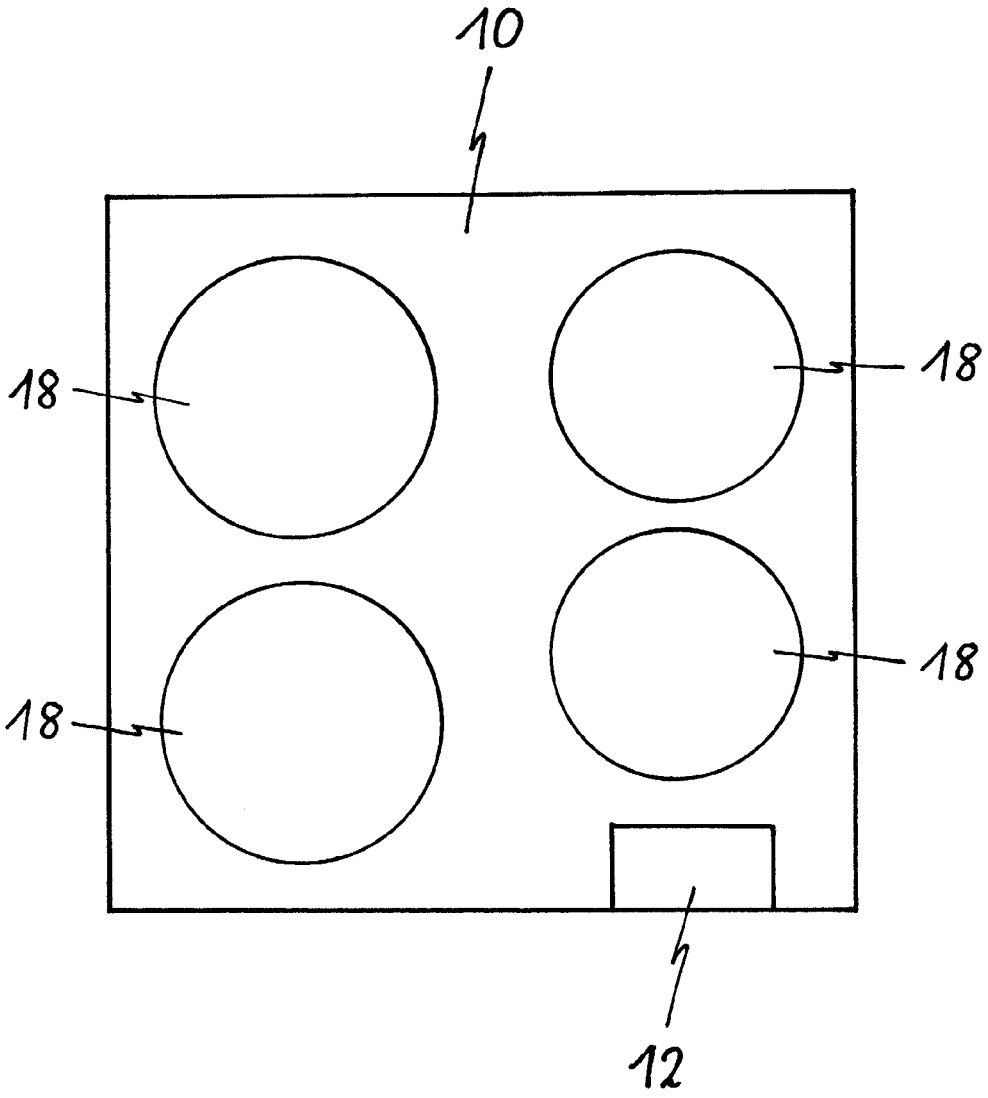

The present invention will be described in further detail with reference to the drawings, in which FIG. 1 illustrates a top view of an induction cooking hob with two cooking areas and a pot detection device according to a first embodiment of the present invention, and FIG. 2 illustrates a top view of the induction cooking hob with four cooking zones and a pot detection device according to a second embodiment of the present invention.

FIG. 1 illustrates a top view of an induction cooking hob with a pot detection device according to a first embodiment of the present invention. The induction cooking hob includes a cooking surface 10 and a user interface 12. The cooking surface 10 comprises a first cooking area 14 and a second cooking area 16. The user interface 12 comprises input elements and one or more displays.

In this embodiment, the cooking surface 10 comprises two cooking areas 14 and 16. In general, the cooking surface 10 may comprise an arbitrary number of cooking areas. Each cooking area 14 and 16 includes or corresponds with one or more induction coils. Each induction coil is connected to a high-frequency generator and to a control unit.

The user can decide if he switches on one single cooking area 14 or 16 or if activates all cooking areas 14 and 16. In the latter case, the cooking areas 14 and 16 may have different power settings, and a cooking vessel may be moved from one cooking area 14 or 16 to another cooking area 16 or 14 during the cooking process. The pot detection device must be activated on all cooking areas 14 and 16.

If there is no cooking vessel on the cooking area 14 or 16, then said cooking area 14 or 16, respectively, is automatically switched off after a predetermined time interval. For example, the time interval may be about ten minutes. When the cooking area 14 or 16 is automatically switched off, then the actual cooking modes are stored in a control unit and a dedicated indication is shown on the display of the user interface 12 in order to remind the user that he has to perform an operation. In this situation, the user may touch or press a key on the user interface 12 in order to activate again the cooking area 14 or 16. In this case, the cooking area 14 or 16 is reactivated with the initial settings selected by the user.

If the user puts the cooking vessel on the cooking area 14 or 16, which has been automatically switched off, then no signal is indicated. When the cooking area 14 or 16 is switched off, then the pot detection device is deactivated for the corresponding cooking area 14 or 16, respectively.

When the user confirms the restart of the cooking process, then the pot detection device is activated again. If a cooking vessel is detected, then the cooking process is continued at the levels stored in the control unit. By pressing or touching a single key by the user, the cooking process is continued on all cooking areas which were activated before they have been automatically switched off.

In the preferred embodiment, the user interface 12 comprises a colour graphic display with touch keys. When the cooking vessel is removed from the cooking area 14 or 16 and the time interval has elapsed, then those cooking areas 14 and/or 16 being switched off are indicated on the display of the user interface 12. An icon or another symbol is illustrated on the display of the user interface 12. The icon is linked to the sustainability of the cooking area 14 or 16. The icon shows the user that there is an energy saving by switching off the unused cooking area 14 or 16. The touch key is defined that the user can restart again the cooking area 14 or 16 with the same setting as selected before.

FIG. 2 illustrates a top view of the induction cooking hob with cooking zones 18 according to a second embodiment of the present invention. This induction cooking hob also includes the cooking surface 10 and the user interface 12.

In this embodiment, the cooking surface 10 comprises four cooking zones 18. In general, the cooking surface 10 may comprise an arbitrary number of cooking zones 18. Each cooking zone 18 includes or corresponds with one or more induction coils. Each induction coil is connected to a high-frequency generator and to a control unit. The cooking zones 18 have substantially the same functions as the cooking areas 14 and 16 in the first embodiment. The cooking zones 18 are adapted to the usual contours of the bottom plates of the cooking vessels.

The present invention allows the user to select the same or different power settings and different temperatures on the cooking areas 14 and 16 as well as on the cooking zones 18. When the cooking areas 14 or 16 or the cooking zones 18 are automatically switched off due to the elapsed time interval after the cooking vessel has been removed, then the user gets a clear indication in the display of the user interface 12. Then, the user can actuate a dedicated touch key in order to restore the cooking areas 14 and 16 and the cooking zones 18 at those levels, which he has selected at the beginning of the cooking process.

At last, the induction cooking hob comprises a function, wherein the user can press or touch a button or key in order to lower the power of all activated cooking areas 14 and 16 and/or cooking zones 18. In this case, the power of the cooking areas 14 and 16 and/or cooking zones 18 are switched to a minimum level. Said minimum level may be a so-called "keep warm"-level. A further pressing or touching of said button or key causes a restart from the previous setting.

Although illustrative embodiments of the present invention have been described herein with reference to the accompanying drawings, it is to be understood that the present invention is not limited to that precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 cooking surface
12 user interface
14 first cooking area
16 second cooking area
18 cooking zone

The invention claimed is:

1. An induction cooking hob with a pot detection device, wherein:

the induction cooking hob includes a cooking surface (10) comprising one or more cooking areas (14, 16) and/or cooking zones (18), the induction cooking hob includes a user interface (12) comprising at least one switch element and at least one display, the induction cooking hob includes a control unit for controlling the cooking area(s) (14, 16) and/or the cooking zone(s) (18), the pot detection device is provided for checking, if a cooking vessel is placed on the cooking area(s) (14, 16) and/or cooking zone(s) (18), the control unit is provided for switching off the cooking area(s) (14, 16) and/or cooking zone(s) (18), if the pot detection device has identified that the cooking vessel has been removed from said cooking area(s) (14, 16) and/or the cooking zone(s) (18), the control unit is provided for storing a last-executed cooking mode of that or those cooking area(s) (14, 16) and/or cooking zone(s) (18), which has or have been switched off, the display is provided for indicating that the cooking area(s) (14, 16) and/or cooking zone(s) (18) has or have been switched off, and the switch element is provided for restarting the cooking area(s) (14, 16) and/or cooking zone(s) (18), which has or have been switched off before, in the last-executed cooking mode stored by the control unit.

2. The induction cooking hob according to claim 1,
characterized in, that the control unit is provided for switching off the cooking area(s) (14, 16) and/or cooking zone(s) (18) after a predetermined time interval, if the pot detection device has identified that the cooking vessel has been removed from said cooking area(s) (14, 16) and/or the cooking zone(s) (18).

3. The induction cooking hob according to claim 2,
characterized in, that the predetermined time interval is about ten minutes.

4. The induction cooking hob according to claim 1,
characterized in, that the display comprises an icon provided for indicating that the cooking area(s) (14, 16) and/or cooking zone(s) (18) has or have been switched off.

5. The induction cooking hob according to claim 1,
characterized in, that the pot detection device is deactivated for those cooking area(s) (14, 16) and/or cooking zone(s) (18), which has or have been switched off.

6. The induction cooking hob according to claim 1,
characterized in, that the pot detection device is activated for those cooking area(s) (14, 16) and/or cooking zone(s) (18), which has or have been restarted again.

7. The induction cooking hob according to claim 1,
characterized in, that the switch element is a touch key.

8. The induction cooking hob according to claim 1,
characterized in, that the user interface (12) is a touch screen.

9. The induction cooking hob according to claim 1,
characterized in, that the user interface (12) comprises a switch element for lowering the power of all active cooking area(s) (14, 16) and/or cooking zone(s) (18) to a minimum level.

10. A method for operating an induction cooking hob with a pot detection device, wherein said method comprises the step of:

checking the activated cooking area(s) (14, 16) and/or cooking zone(s) (18), if a cooking vessel is placed thereon, identifying that or those cooking area(s) (14, 16) and/or cooking zone(s) (18), from which the cooking vessel has been removed, switching off that or those cooking area(s) (14, 16) and/or cooking zone(s) (18), from which the cooking vessel has been removed, storing a last-executed cooking mode of that or those cooking area(s) (14, 16) and/or cooking zone(s) (18), which has or have been switched off, and providing an opportunity for a user to restart that or those cooking area(s) (14, 16) and/or cooking zone(s) (18) in the last-executed cooking mode stored before, the cooking area(s) (14, 16) and/or cooking zone(s) (18) has or have been switched off.

11. The method according to claim 10,
characterized by switching off that or those cooking area(s) (14, 16) and/or cooking zone(s) (18), from which the cooking vessel has been removed, after a predetermined time interval.

12. The method according to claim 11,
characterized in, that the predetermined time interval is about ten minutes.

13. The method according to claim 10,
characterized by deactivating the pot detection device for that or those cooking area(s) (14, 16) and/or cooking zone(s) (18), which has or have been switched off.

14. The method according to claim 10,
characterized by activating the pot detection device for that or those cooking area(s) (14, 16) and/or cooking zone(s) (18), which has or have been restarted again by the user.

15. The method according to claim 10,
characterized in, that the method is provided for an induction cooking hob with a pot detection device, wherein:

the induction cooking hob includes a cooking surface (10) comprising one or more cooking areas (14, 16) and/or cooking zones (18), the induction cooking hob includes a user interface (12) comprising at least one switch element and at least one display, the induction cooking hob includes a control unit for controlling the cooking area(s) (14, 16) and/or the cooking zone(s) (18), the pot detection device is provided for checking, if a cooking vessel is placed on the cooking area(s) (14, 16) and/or cooking zone(s) (18), the control unit is provided for switching off the cooking area(s) (14, 16) and/or cooking zone(s) (18), if the pot detection device has identified that the cooking vessel has been removed from said cooking area(s) (14, 16) and/or the cooking zone(s) (18), the control unit is provided for storing a last-executed cooking mode of that or those cooking area(s) (14, 16) and/or cooking zone(s) (18), which has or have been switched off, the display is provided for indicating that the cooking area(s) (14, 16) and/or cooking zone(s) (18) has or have been switched off, and the switch element is provided for restarting the cooking area(s) (14, 16) and/or cooking zone(s) (18), which has or have been switched off before, in the last-executed cooking mode stored by the control unit.

16. The induction cooking hob according to claim 1, wherein the cooking mode comprises a set of cooking parameters set by a user before the cooking area(s) (14, 16) and/or cooking zone(s) (18) was or were switched off.

17. The induction cooking hob according to claim 1, wherein the display indicates to the user the last-executed cooking mode of the cooking area(s) (14, 16) and/or cooking zone(s) (18), which has or have been switched off.

* * * * *